United States Patent [19]

Osborne

[11] 4,059,960

[45] Nov. 29, 1977

[54] METHOD AND APPARATUS FOR TESTING THE MOVABILITY OF VALVE PLUGS

[75] Inventor: Robert L. Osborne, Wallingford, Pa.

[73] Assignee: Westinghouse Electric Corporation, Pittsburgh, Pa.

[21] Appl. No.: 665,821

[22] Filed: Mar. 11, 1976

[51] Int. Cl.[2] ..... F01K 13/00

[52] U.S. Cl. ..... 60/646; 60/657; 116/67 R; 116/125; 137/554; 137/556; 340/220; 415/16

[58] Field of Search ..... 415/13, 16, 15, 118; 60/646, 657; 340/220; 116/67, 125; 137/551, 554, 556; 290/40 R, 4 R

[56] References Cited

U.S. PATENT DOCUMENTS

| | | | |
|---|---|---|---|
| 2,617,438 | 11/1952 | Doran | 415/16 |
| 2,998,017 | 8/1961 | Cavalieri | 415/16 |
| 3,342,194 | 9/1967 | Dwight | 415/16 |
| 3,682,564 | 8/1972 | Feeney | 415/16 |

*Primary Examiner*—Allen M. Ostrager
*Attorney, Agent, or Firm*—J. W. Keen

[57] ABSTRACT

A method and apparatus for testing the movability of a valve plug. The invention provides for movement of the valve plug from a first to a second position, from the second to a third position in an opposite direction, and again in the first direction to the first position. Indicators are provided to ascertain if such movements have occurred. Alarm signals are generated if any of the movements do not occur. The magnitude of the motions of the plug is normally small relative to the full valve stroke. Size of stroke and time at each position are chosen to minimize any disturbance to the power system.

14 Claims, 8 Drawing Figures

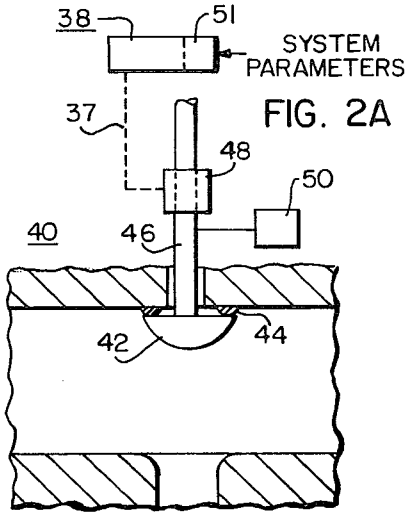
FIG. 2A
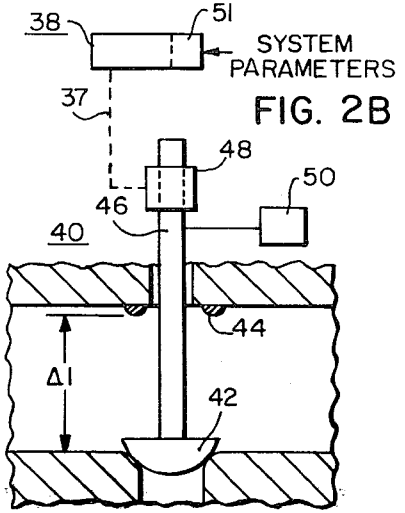
FIG. 2B
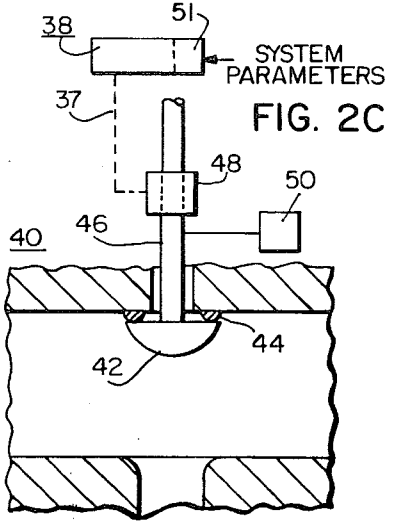
FIG. 2C
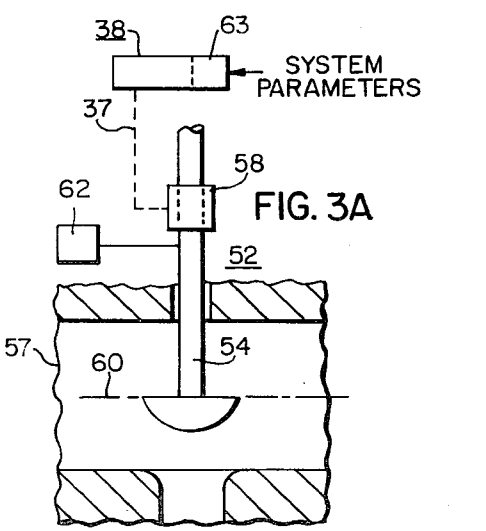
FIG. 3A
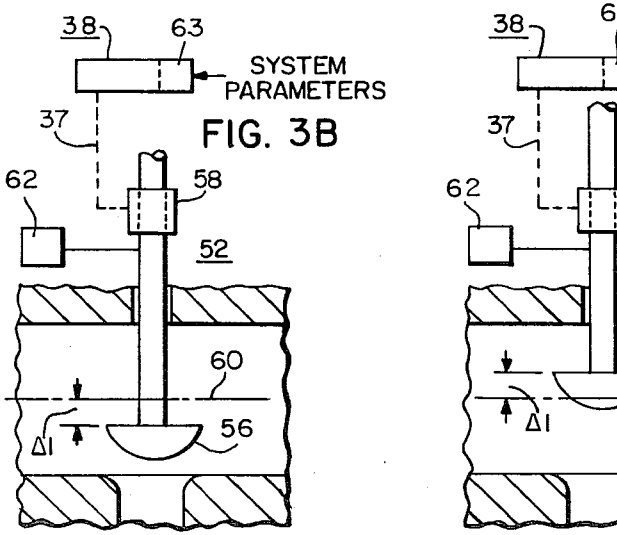
FIG. 3B
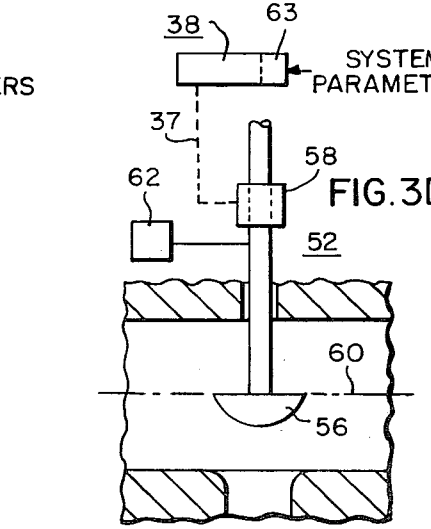
FIG. 3C
FIG. 3D

METHOD AND APPARATUS FOR TESTING THE MOVABILITY OF VALVE PLUGS

BACKGROUND OF THE INVENTION

1. Field of the Invention

The invention relates to steam turbine power plants, and in particular, to a method and apparatus for testing the movability of valve plugs used with the turbine generator.

2. Description of the Prior Art

In general, a nuclear steam turbine power plant includes a series connected arrangement having a steam generator element, a high pressure turbine element and a low pressure turbine element with a combined moisture separator reheater disposed therebetween. Interconnected within the plant are various flow control devices whose function is to modulate and/or completely interdict the flow of motive steam within the power plant.

It is well known that such flow control members are susceptible to buildup of frictional forces therewithin, which, if undetected, could cause premature failure of the valve and an attendant emergency condition within the power plant. It is for this reason that the various regulatory agencies concerned with the safety of such generating stations mandate frequent valve testing and inspections in order to ascertain their availability.

However, in the prior art, valves are tested while the system is at a reduced load level, since each valve tested must be completely closed and then reopened. These valve movements, if done at full load, would cause a significant, sudden change in load. Thus, by reducing load, and then closing and reopening each valve, the movability of each valve plug may be checked without significantly changing load.

The form of valve testing has, in the past, been generally accomplished not oftener than once per week. Recent statements from regulatory agencies charged with the review of safety practices indicate a desire to have daily valve testing provided. To meet this goal using traditional, prior art, valve testing techniques would require utilities to devote considerably more operating time at reduced power outputs. Further, this prospect is especially unattractive in nuclear stations because utilities wish to fully utilize the advantages of lower fuel costs and operate the higher capital cost nuclear units at as full a capacity as possible.

SUMMARY OF THE INVENTION

This invention provides a method and an apparatus to test the movability of on-line flow control devices. The invention includes moving the valve plug of a particular valve a first predetermined distance in a first predetermined direction and ascertain if the movement has, in fact, occurred. If not, a suitable alarm signal is generated. The invention then, for valves in a modulating position, deflects the plug a second predetermined distance in an opposite direction. If this movement has not occurred, a suitable alarm signal is generated. The plug is then returned to the original position. The magnitude of the distances and the time away from the original plug position are dependent upon and associated with various system parameters,such as the load imposed on the system and the time delay of elements therein.

It is an object of this invention to provide an apparatus and a method for testing the movability of on-line valves in a steam power plant without significantly affecting the load thereof. Other objects of the invention will become clear from the following description of the preferred embodiment.

BRIEF DESCRIPTION OF THE DRAWING

The invention will be readily ascertainable from the following description of the preferred embodiments thereof, taken in connection with the accompanying drawings, in which:

FIGS. 2 and 3 are schematic representations of the apparatus and method steps for ascertaining the movability of valve plugs within the power plant of FIG. 1 which embody the teachings of this invention.

DESCRIPTION OF THE PREFERRED EMBODIMENT

Figure 1:
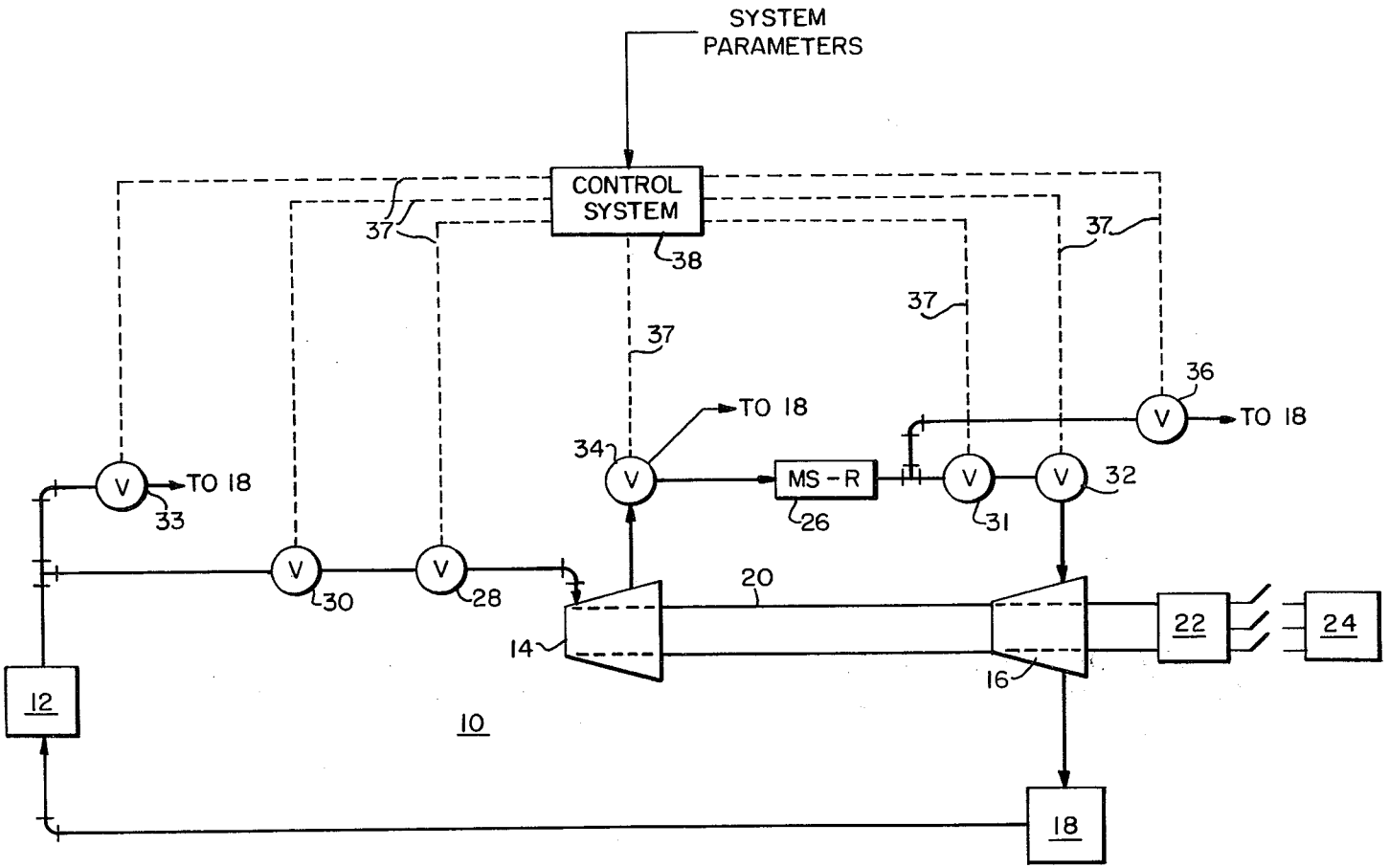
FIG. 1 is a schematic view of a steam turbine power plant.

Throughout the following description, similar reference characters refer to similar elements in all Figures of the drawings.

As is known, a nuclear steam turbine power plant 10 generally includes a series-connected arrangement having a steam generator 12 element, a high pressure turbine 14, at least one low pressure turbine 16 and a condenser 18. Both the high pressure turbine 14 and the low pressure turbine 16 are mounted on a common shaft 20 and convert the energy carried by the motive steam into rotational mechanical energy of the shaft 20. The shaft 20 is connected to an electrical generator element 22 which converts mechanical energy of the shaft 22 to electrical energy to supply an associated electrical load 24. Intermediate between the exhaust of the high pressure turbine element 14 and the inlet of the low pressure turbine 16 is a combined moisture separator-reheater element 26.

Disposed at various predetermined locations throughout the power plant 10 are several flow control devices adapted either to modulate or interdict motive fluid flow through various portions of the plant 10. For example, intermediate between the steam generator element 12 and the inlet of the high pressure turbine 14 are disposed one or more main control valves 28. The control valve 28 acts to modulate the flow rate of fluid entering the high pressure turbine 14. Other position modulated flow control devices may be located at various predetermined locations within the power plant 10, in a manner known to those skilled in the art. Also disposed upstream of the inlet of the high pressure turbine 14 are one or more normally open main turbine throttle-stop valves 30. The throttle-stop valve 30 acts to interdict the flow of motive steam into the high pressure turbine 14 in the event of certain system occurrences. Similar in purpose are one or more reheat stop valves 31 disposed upstream of the low pressure turbine 16. Also located upstream of the low pressure turbine element 16 is an interceptor valve 32.

Also provided in the system are a plurality of normally-seated bypass valves, such as those illustrated at 33, 34 and 36. These bypass valves, upon their actuation, bypass motive fluid flow about the power producing turbine elements 14 and 16 and directly to the condenser or atmosphere in the event of system malfunctions. Interconnected between all of the above cited valves by the shown control interconnections 37 and receiving input data from various system locations, including the generator output and turbine rotating speed is a control system 38 adapted to monitor various system parameters and to implement variations in motive fluid flow rates in response to these system parameters through the modulation, opening and closing of the various flow control devices mentioned. The control system 38 may utilize a special purpose digital computer which monitors the various system parameters in order to carry out the control task assigned.

During normal operation of the power plant 10, it is known that the total power output of the plant 10 is the sum of the power outputs of both the high pressure turbine element 14 and the low pressure turbine element 16. However, changes in power output of the low pressure turbine 16 are delayed because of the time lag due to the steam compressibility and heat capacity present in the moisture separator-reheater element 26. Thus, the moisture separator-reheater element 26 (MS-R) creates a system time lag of a predetermined amount. The system time lag may be understood from an understanding of the physical situation extant in the system 10. This time lag is due to the compressability and heat capacity characteristics of the MS-R. In nuclear plants, this time lag is characteristically 4 seconds.

There has been recent interest by regulatory authorities as to the reliability of the control system to prevent certain overspeed conditions which, if unimpeded, could initiate the emission of missiles from the turbine. As a result, daily, as opposed to weekly, valve testing has been recommended. However, since valve testing as currently practiced can involve considerable time and undesirable load reductions, it is advantageous to find an alternative to daily valve testing which would permit frequent on-line valve testing and give increased assurance that critical valves are operational.

This invention discloses a system whereby valves are tested on-line for free movement over a small portion of their full strokes at relatively frequent time intervals, such as daily or hourly. This method would insure a high probability of valve operability and thus would reduce the possibility of turbine overspeed due to valve failure.

As stated earlier, valves within the power plant may occupy any of three positions. A valve, such as the bypass valves 33, 34 or 36, is maintained in the fully closed position. Other valves, such as the throttle-stop valves 30 and the stop valve 31, are normally maintained in a fully open position. By fully closed, it is meant that the valve plug is engaged against its seat and no fluid flow from valve inlet to outlet is permitted. Fully open describes that condition wherein the valve plug is abutted against its back seat and the fluid passes uninhibited through the valve from inlet to outlet. Other valves, such as the control valve 28, can occupy a modulating flow position between wide open and fully closed.

Turbine inlet valves in the fully closed position require no testing, as they are already in the failsafe position.

For a description of testing of valves in the backseated position, reference is directed to the test sequence depicted graphically in FIGS. 2A, 2B and 2C.

With reference to FIG. 2A, a valve 40 is shown having its plug 42 abutted against the backseat structure 44 and so that the valve plug 42 is fully open. The plug 42 is securely affixed to a stem 46 which in turn is connected to a suitable actuator 48. At a predetermined interval, dependent upon a variety of factors not relevant here, the control system 38, through the appropriate control linkage 37, initiates the actuator 48 to move the plug 42 from the backseat 44 for a predetermined distance Δ1, as seen in FIG. 2B. The magnitude of the distance Δ1 is dependent upon factors such as rate of flow through the valve, and the stroke vs. flow relationship upon the system, but Δ1 is less than the full valve stroke. The point is that the plug is moved a sufficient distance to indicate that friction within the valve has not rendered the plug immovable, while at the same time, the plug is not moved a distance which would significantly disturb flow through the valve and thus not disturb the power output. The time duration of the stay in the displaced position is not critical.

Suitable sensing means 50, such as a linear variable differential transducer (LVDT) is used to check that the valve plug 42 has, in fact, displaced the distance Δ1 in response to the signal from the control 38. If the means 50 determines that the deflection Δ1 called for has, in fact occurred, the valve tested is shown to be free to move.

However, if the sensing means 50 determines that the deflection Δ1 has not occurred, a signal is generated to the control 38 indicative of this fact. Suitable alarm to the fact that the valve is stuck is then given and corrective measures then initiated. The final step in the procedure is the return of the plug 42 to its original position, in response to a suitable signal from the control 38. This movement is also monitored.

It is appreciated that such a test sequence insures that plugs in the backseated position are checked to indicate whether friction levels therein have exceeded predetermined permissible levels so as to prevent operation of the valve. Also, if certain other defects to the valve have occurred which would prevent its operation, this fact is ascertained. It is noted that the small deflection Δ1 does not significantly affect load or flow, yet permits the determination of whether the plug is free to move. Testing of the other fully backseated valves in the system may proceed either sequentially or simultaneously. All testing, of course, embodies the procedure described above.

The testing procedure for those valves disposed in a modulating flow position is described in accordance with FIGS. 3A-D. In FIG. 3A, a valve 52 having a stem 54 with a plug 56 thereon is disposed in a modulating position within a valve casing 57. The stem is attached to a valve actuator 58. For convenience, the initial modulating location is indicated by a datum 60 which extends through all of the associated figures. Initially, as shown in FIG. 3A, the plug 56 lies along the datum 60. Upon a suitable signal from the control 38 to the actuator 58, the plug 56 is displaced a predetermined distance Δ1 along an axis through the stem, either toward the open or closed (seated) position. In practice, the test signal may be a perturbation signal (usually a square wave) conveniently superimposed on the normal control signals to the valve 52. The displacement Δ1 is shown as placing the plug 56 closer to the fully seated position, although it is understood that the initial displacement of the plug 56 may be oppositely directed.

The magnitude of the displacement Δ1 may be any distance suitable to positively indicate that valve movement is possible, yet must not be of such a magnitude as to significantly disrupt either the flow rate or the load when done for only a few seconds. Typically, the distance Δ1 could be one-quarter inch for several seconds. Suitable means 62, such as an LVDT, are provided to check whether the plug 56 has, in fact, responded to the perturbation signal and deflected the distance Δ1. If it is determined that the plug has not displaced the distance Δ1, a signal to this effect is generated to the control 38 for actuation of the alarm.

After a predetermined period of time, $t_1$, the control 38 initiates signal to the actuator 58 to displace the plug 56 a distance twice Δ1 in the direction opposite the initial displacement. The result of such displacement, as seen in FIG. 3C, is disposing the valve a distance Δ1 above the datum 60, i.e., closer to the backseat. The means 62 again ascertains whether such deflection has occurred, and if not, generates a signal indicative of the fact that movement in the second direction is precluded.

After a second predetermined period of time, $t_2$, the control 38 initiates a displacement of Δ1 in the original direction to replace the plug 56 at its original datum, as indicated at FIGS. 3D. The time periods $t_1$ and $t_2$ are equal and chosen so that the sum of $t_1$ plus $t_2$ is approximately equal to the time lag, or system time constant, of the moisture separator-reheater 26. The combination of the time delay of the reheater results in little effect on the load. Other modulating valves in the system maybe tested sequentially in the same manner.

Of course, the displacement distance need not all be multiples of distance Δ1. Again, the key criterion is that the plug is caused to move away from its original position in a first direction for a first distance, in an opposite direction for a second distance, and then returned to the original location. The displacements need not displace the plug to equal distances on each side of the datum to be within the scope of this invention. Only the displacements in opposite directions and return to normal operating position is required to provide an on-line test indication of the movability of plugs in flow control devices.

It is also to be understood that, in the modulating valve situation, a single displacement Δ1 and return to datum 60 falls within the scope of this invention. Other variations include a series of sine waves, triangular waves, or other wave forms at an amplitude and period commensurate with those suggested for the square wave perturbation signal described previously.

It is also to be understood that, in the modulating valve situation, a single displacement Δ1 and return to datum 60 falls within the scope of this invention. And, as will be discussed herein, this invention also includes within its scope dynamic testing arrangements utilizing oscillating perturbation signals, including square waves, triangular waves, sine waves or other wave form at an amplitude and period commensurate with those suggested for the square wave perturbation signal described above.

As described earlier, the valve test perturbation signal is superimposed over the normal control signals given to each valve within the system by the control 38 through the control interconnections 37. As is well known, the control 38 actuates each valve to respond to a variety of system parameters. Therefore, the possibility exists that the valve test perturbation signal may be negated in its effect due to receipt by the particular valve of a signal from the control 38 which would counter the signal received from the test signal. For example, the control system 38 monitors the frequency of the associated load network 24 such that a change in that frequency would necessitate in change in valve position within the generating system. Thus, a reduction in load frequency would initiate a response by the control system 38 which would alter the modulating position of the valve. It is possible that the signal generated in response to the load frequency shift could contemporaneously occur with the valve test signal, with the result that the valve would respond to both, and in so responding, seemingly indicate to the sensors that the valve did not respond to the test signal. Thus, a false alarm could be generated.

It is, of course, highly unlikely that such a combination of conflicting signals would occur at the precise time and in the precise sequence that the test signals are given to the valve. However, to completely forestall any possibility of such occurrence, several possible alternative arrangements are available and are described as further refinements of the testing arrangement disclosed herein.

One possible alternative would be to totally isolate the valve from all other incoming control signals during the valve test sequence. Thus, the normal control signals, be they from the frequency shift arrangement, from the Automatic Dispatch System, or from any other control source, would be temporarily preempted during test procedure. This would insure non-participation of the valve to such signals during the test sequence. Thus, as shown in FIG. 2, there is provided within the control system 38 isolating means 51 for temporarily isolating the control system 38 from those system parameters to which it is normally responsive. In operation, the well known system parameters (such as line frequency changes, Automatic Dispatch System inputs) provide a basis for a signal known as "Flow Demand" which is generated in the control system 38. The position of the valves in the system depends on the value of the Flow Demand signal. The means 51 passes the actual flow demand signal to the valve control system 38 if it is determined that no valve test sequence is in progress. However, if it is determined that the valve test is in progress, the means 51 provides a flow demand signal to the control 38 that is equal to the last actual flow demand value prior to initiation of the valve test sequence. For example, a relay may be utilized which would close upon initiation of the valve test and which maintains the flow demand signal at a value equal to the last flow demand signal prior to initiation of the test. Once the test is completed, the contacts open, and actual flow demand signal values are conducted to the control 38.

Alternatively, it may be desired that the valve be able to respond to such incoming signals, even during the test sequence. Therefore, to avoid any possibility of false alarm, a signal storage capability may be provided which stores the signals received (and acted upon) by the valve during the test sequence above described. After the test sequence is completed, yet before the results are indicated to the operator, means are provided which would determine whether the signals received and acted upon were such as to invalidate the test. Thus, if signals indicating a response to a significant frequency shift, or to reference loading had been received and acted upon during the test sequence, the results of the test could be voided, no indication given to the operator, and the test sequence re-initiated at a predetermined later time. At the completion of each test sequence, the validity check may be made, with indication of test results being provided to the operator only if the test was determined to be valid. As shown at FIG. 3, there is provided within the control system 38 interdiction and storage means 63 for determining if actual flow demand signal received during the valve test sequence deviates more than a predetermined acceptable amount from the value of the last flow demand signal received prior to the initiation of the valve test. The means 63 could include two comparators, one of which determines, for all times during the valve test, whether the actual flow demand is within a predetermined range of values above the last flow demand signal received prior to the initiation of the valve test sequence. The second comparator determines, for all times during the valve test, whether the actual flow demand is within a predetermined range of values below the last flow demand signal received prior to the initiation of the valve test sequence. If either comparator determines a deviation from the last flow demand signal greater than the acceptable range, the valve test is invalidated and reinitiated at a predetermined later time. It is understood, of course, that these illustrative examples for both the means 51 and 63 are not meant to exhaust the implementing alternatives, and are shown by way of illustration and not in a limiting sense.

It is also an alternative to utilize any incoming signal to modify the test results so that they would be meaningful even in view of the incoming signal. For example, the effect of an incoming signal from the Automatic Dispatch System, which would modify the reference datum, can be factored into the test sequence and accounted for so that the test result would be meaningful. Of course, the implementation of any of these alternatives is well known to those skilled in the art.

It is also possible to obtain a more complete indication of the condition of the valve and the effect on the valve's response due to frictional buildup.

Thus, as stated earlier, if the valve received a repeating, superimposed signal and the response thereto analyzed, it is possible to determine the dynamic response of the valve and actuator. This would indicate not only the ability of the plug to reach certain end points of travel, but also indicate whether the movement of the valve to those end points was sluggish, or potentially defective. By monitoring the valve response to the repeating test signal (either square wave, triangular wave, sine wave or any wave form) and by ascertaining the delay in the valve plug following such an input signal, a measure of the quality of the dynamic response of the valve and actuator could be obtained.

Since numerous changes may be made in the above description of applicant's invention without departing from the spirit and scope thereof, it is intended that all subject matter in the foregoing description shall be interpreted as illustrative and not in a limiting sense.

We claim:

1. A steam turbine power plant comprising:

a turbine;

steam generating means for supplying steam to said turbine;

an electrical generator driven by said turbine to generate electrical energy for a predetermined load;

valve means normally movable between a fully open to a fully seated position for controlling the admission of steam into said turbine;

means for controlling the position of said valve means in accordance with an electrical control signal;

means for testing the motion of said valve means during the operation of said turbine without effectively disturbing the predetermined load, said testing means including actuator means for moving said valve means from a first to a second position in a first predetermined direction in response to a testinitiation signal from said control means, means for detecting the responsive movement of said valve means to said actuator means, and, means responsive to said detecting means for indicating that the responsive movement of said valve means has occurred.

2. The steam turbine power plant of claim 1, wherein:

said actuator means further responds to said test initiation signal by exerting a force normally sufficient to move said valve means from said second to a third position in a direction opposite to said first predetermined direction;

said detecting means detecting the further responsive movement of said valve means to said actuator means, and said indicating means indicating that the further responsive movement of said valve means has occurred.

3. The steam turbine power plant of claim 1, wherein:

said actuator means further responds to said test initiation signal by exerting a force normally sufficient to move said valve means to said first position from said second position in a direction opposite said first predetermined direction;

said detecting means detecting the further responsive movement of said valve means to said actuator means, and said indicating means indicating that the further responsive movement of said valve means has occurred.

4. The steam turbine power plant of claim 2, wherein:

said actuator means further responds to said test initiation signal by exerting a force normally sufficient to move said valve means to said first position from said third position in said first predetermined direction;

said detecting means detecting the further responsive movement of said valve means to said actuator means, and said indicating means indicating that the responsive movement of said valve means has occurred.

5. The steam turbine power plant of claim 1, further comprising:

a second turbine element connected in series with said first turbine element;

a moisture separator-reheater element connected between said turbine elements, said moisture separator-reheater element having a predetermined time lag associated therewith;

and wherein, the period of time during which said plug is away from said first position is less than said predetermined time lag associated with said moisture separator-reheater.

6. The steam turbine power plant of claim 1, wherein said test-initiation signal is superimposed over said control signal from said control means.

7. The steam turbine power plant of claim 1, further comprising:

means for isolating said valve means from said electrical control means for a predetermined period of time after said test-initiation signal is received by said actuator means.

8. The steam turbine power plant of claim 1, further comprising:

means for interdicting and storing control signals from said control means to said actuator means for a predetermined period of time after said test-initiation signal is received by said actuator means; and, means for comparing the deviation between the stored control signals and the control signal last received prior to said test-initiation signal with a predetermined acceptable deviation; and means for sending a test-initiation signal to said actuator means at a predetermined later time in response to said comparing means ascertaining an unacceptably large, test invalidating deviation.

9. In a steam turbine power plant having a steam generator element and a turbine, a valve connected in series therewith, wherein the valve having a seat and a back seat therein and a plug in a first position intermediate between the seat and the back seat, the improvement comprising:

means for moving the plug from the first position to a second position in a first direction, means for testing whether the movement from the first position to the second position has occurred, means associated with said testing means for generating an alarm signal at times when the movement of the plug from the first position to the second position has not occurred, means for moving the plug from the second position to a third position in a direction opposite the first direction, means for testing whether the movement from the second position to the third position has occurred, means associated with said testing means for generating an alarm signal at times when the movement of the plug from the second position to the third position has not occurred; and, means for returning the plug to the first position from the third position.

10. The power plant according to claim 9, having a moisture separator-reheater connected in series therein, said moisture separator having a time lag associated therewith, and wherein, the plug is away from the first position for a period of time less than the time lag of the moisture separator-reheater.

11. A method for testing the movability of a valve plug comprising the steps:

a. signaling an actuator to exert a force normally sufficient to move the plug in a first direction from a first position to a second position, and, b. generating an alarm signal if the movement from the first position to the second position has not occurred.

12. The method of claim 11, further comprising:

c. signaling the actuator to exert a force normally sufficient to move the plug in a second direction opposite the first direction from the second position to a third position, d. generating an alarm signal if the movement from the second to the third position has not occurred, and, e. signaling the actuator to exert a force normally sufficient to move the plug in the first direction to the first position.

13. The method of claim 11, further comprising the step:

c. signaling the actuator to exert a force normally sufficient to move the plug in a second direction opposite to the first direction from the second position to the first position.

14. The method of claim 12, further comprising the step:

f. maintaining said plug away from said first position for a predetermined time period less than a time lag associated with an element to which the valve is connected.

* * * * *